US008997883B2

(12) United States Patent
Gette et al.

(10) Patent No.: US 8,997,883 B2
(45) Date of Patent: Apr. 7, 2015

(54) ANNULUS SEAL WITH STEPPED ENERGIZING RING

(75) Inventors: Nicholas Peter Gette, Houston, TX (US); Benjamin Michael Snyder, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 187 days.

(21) Appl. No.: 13/612,062

(22) Filed: Sep. 12, 2012

(65) Prior Publication Data

US 2014/0069661 A1 Mar. 13, 2014

(51) Int. Cl.
*E21B 19/00* (2006.01)
*E21B 33/04* (2006.01)

(52) U.S. Cl.
CPC ..... *E21B 33/04* (2013.01)

(58) Field of Classification Search
CPC ..... E21B 33/03; E21B 33/04
USPC ..... 166/368, 387, 88.1, 84.1, 85.3, 75.11; 277/329
See application file for complete search history.

(56) References Cited

U.S. PATENT DOCUMENTS

| | | | | |
|---|---|---|---|---|
| 4,641,708 | A | 2/1987 | Wightman | |
| 4,665,979 | A | 5/1987 | Boehm, Jr. | |
| 4,932,472 | A | 6/1990 | Boehm, Jr. | |
| 4,960,172 | A | 10/1990 | Nelson | |
| 5,067,734 | A | 11/1991 | Boehm, Jr. | |
| 5,456,314 | A | 10/1995 | Boehm, Jr. et al. | |
| 7,762,319 | B2 * | 7/2010 | Nelson | 166/84.1 |
| 8,186,426 | B2 * | 5/2012 | Nelson | 166/88.3 |
| 8,312,922 | B2 * | 11/2012 | Nelson | 166/208 |
| 2010/0126736 | A1 | 5/2010 | Ellis et al. | |
| 2010/0147533 | A1 | 6/2010 | Nelson | |
| 2010/0300705 | A1 | 12/2010 | Nelson | |

* cited by examiner

*Primary Examiner* — William P Neuder
(74) *Attorney, Agent, or Firm* — Bracewell & Giuliani LLP

(57) ABSTRACT

A wellhead seal assembly that forms a metal-to-metal seal between inner and outer wellhead members. A seal member has inner and outer walls separated by a slot, where the slot has an upper portion that is wider than a lower portion of the slot. An energizing ring having an upper end portion and a nose is moved into the slot, where the upper end portion has a greater cross-sectional thickness than the nose. As the energizing ring is moved into the slot, the nose of the energizing ring engages the lower portion of the slot to form a lock against the walls of the inner and outer wellhead members, and the upper end portion of the energizing ring engages the upper portion of the slot to form a seal against the walls of the inner and outer wellhead members.

18 Claims, 2 Drawing Sheets

ANNULUS SEAL WITH STEPPED ENERGIZING RING

FIELD OF THE INVENTION

This invention relates in general to wellhead assemblies and in particular to a stepped energizing ring that allows the sealing and lockdown functions of an associated seal member to be separately configured.

BACKGROUND OF THE INVENTION

Seals are used between inner and outer wellhead tubular members to contain internal well pressure. The inner wellhead member may be a casing hanger located in a wellhead housing that supports a string of casing extending into the well. A seal or packoff seals between the casing hanger and the wellhead housing. Alternatively, the inner wellhead member could be a tubing hanger that supports a string of tubing extending into the well for the flow of production fluid. The tubing hanger lands in an outer wellhead member, which may be a wellhead housing, a Christmas tree, or a tubing head. A packoff or seal seals between the tubing hanger and the outer wellhead member. In addition to the seal between the inner and outer wellhead members, another annular seal, or emergency seal, may be located below this seal.

A variety of annulus seals of this nature have been employed. Conventional annulus seals include, for example, elastomeric and partially metal and elastomeric rings. Prior art seal rings made entirely of metal for forming metal-to-metal seals are also employed. The seals may be set by a running tool or they may be set in response to the weight of the string of casing or tubing. One type of metal-to-metal seal has inner and outer walls separated by a conical slot. An energizing ring is pushed into the slot to deform the inner and outer walls apart into sealing engagement with the inner and outer wellhead members. The energizing ring is a solid wedge-shaped member. The deformation of the inner and outer walls exceeds the yield strength of the material of the seal ring, making the deformation permanent.

Thermal growth between the casing or tubing and the wellhead may occur. The well fluid flowing upward through the tubing heats the string of tubing, and to a lesser degree the surrounding casing. The temperature increase may cause the tubing hanger and/or casing hanger to move axially a slight amount relative to the outer wellhead member or each other. During the heat up transient, the casing hanger and/or tubing hanger can also move radially due to temperature differences between components and the different rates of thermal expansion from which the component materials are constructed. If the seal has been set as a result of a wedging action where an axial displacement of energizing rings induces a radial movement of the seal against its mating surfaces, then sealing forces may be reduced if there is movement in the axial direction due to pressure or thermal effects. A reduction in axial force on the energizing ring results in a reduction in the radial inward and outward forces on the inner and outer walls of the seal ring, which may cause the seal to leak. A loss of radial loading between the seal and its mating surfaces due to thermal transients may also cause the seal to leak.

A need exists for a technique that addresses the seal leakage problems described above. In particular a need exists for a technique to provide a seal with separate sealing and locking features so that the performance of said features can be tuned separately.

SUMMARY OF THE INVENTION

In an embodiment of the present technique, a wellhead seal assembly is provided that forms a metal-to-metal seal between inner and outer wellhead members. The wellhead seal assembly includes a seal member that has inner and outer walls separated by a slot, where the slot has an upper portion that is wider than a lower portion of the slot. An energizing ring having an upper end portion and a nose is moved into the slot, where the upper end portion has a greater cross-sectional thickness than the nose. As the energizing ring is moved into the slot, the nose of the energizing ring engages the lower portion of the slot to form a lock against the walls of the inner and outer wellhead members, and the upper end portion of the energizing ring engages the upper portion of the slot to form a seal against the walls of the inner and outer wellhead members.

In an example embodiment, a set of wickers is formed in at least one of the outer and inner walls of the seal member, the set of wickers being positioned to be adjacent to the lower portion of the slot. The set of wickers forms the lock against the inner and outer wall portions of the inner and outer wellhead members to thereby minimize axial movement of the seal member when the nose of the energizing ring engages the lower portion of the slot.

In an example embodiment, at least one of the outer and inner walls of the seal member has a sealing surface including a set of indentations for concentrating contact pressure, the sealing surface being positioned to be adjacent to the upper portion of the slot. The sealing surface forms the seal against the outer wall portions of the inner wellhead member when the upper end of the energizing ring engages the upper portion of the slot.

The separation of the locking feature (i.e., wickers) and sealing feature (i.e., sealing surface) of the seal member advantageously allow the features to be independently configured in order to tune their performance.

DETAILED DESCRIPTION OF THE INVENTION

Figure 1:
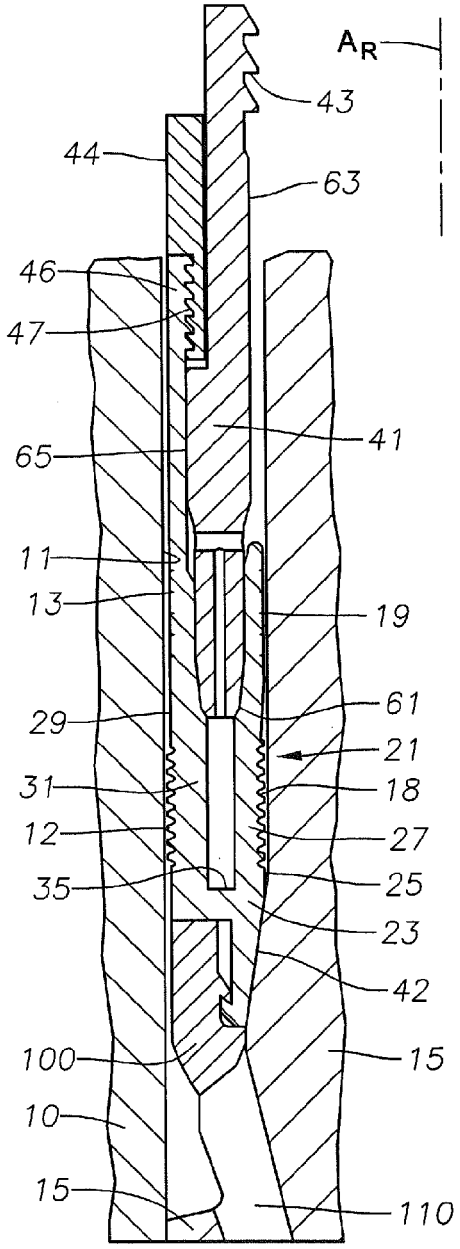
FIG. 1 is a sectional view of a seal assembly being lowered between outer and inner wellhead members, in accordance with an embodiment of the invention.

Referring to FIG. 1, an embodiment of the invention shows a portion of a wellhead assembly that includes high pressure wellhead housing 10. In this example, housing 10 is located at an upper end of a well and serves as an outer wellhead member of the wellhead assembly. Housing 10 has bore 11 located therein. In this example, an inner wellhead member is casing hanger 15, which is shown partially in FIG. 1 within bore 11. Alternately, wellhead housing 10 could be a tubing spool or a Christmas tree, and casing hanger 15 could instead be a tubing hanger, plug, safety valve, or other device. Casing hanger 15 has an exterior annular recess radially spaced inward from bore 11 to define seal pocket 17.

Continuing to refer to FIG. 1, metal-to-metal seal assembly 21 is lowered between housing 10 and casing hanger 15 and located in seal pocket 17. Seal assembly 21 includes seal ring 23 formed of a metal such as steel. Seal ring 23 has inner wall surface 25 comprised of inner seal leg 27 for sealing against the cylindrical wall of casing hanger 15. Seal ring 23 has outer wall surface 29 comprised of outer seal leg 31 that seals against wellhead housing bore 11. Wickers 12, 18 are located on a lower portion of outer wall surface 29 of outer seal leg 31 and a lower portion of inner wall surface 25 of inner seal leg 27. Outer wall 29 of outer seal leg 31 and inner wall 25 of inner seal leg 27 may also have interruptions 13, 19 (e.g., indentations, O-ring slots, curved grooves, etc.) adjacent to upper portion 37 of slot 35.

Wickers 12, 18 may include triangular grooves parallel to each other. In other embodiments, wickers 12, 18 may include concentric grooves, which are triangular in configuration. In this example, the profiles of each set of wickers 12, 18 are shown as continuous profiles on seal ring 23; however, wickers 12, 18 may be configured in other arrangements. Wickers 12, 18 of each wall surface 25, 29 engage and embed into walls of housing 10 and casing hanger 15, respectively. The engaging surfaces of housing 10 and casing hanger 15 may be formed of a softer metal than that of wickers 12, 18; or wickers 12, 18 may contain an inlay of soft metal. Further, wickers 12, 18 may be formed from a different type of metal that is harder than that of the engaging surfaces of housing 10 and casing hanger 15. Wickers 12, 18 enhance the grip to aid in the prevention of axial movement of seal ring 23 once set. In some embodiments, wickers 12, 18 are axially scored (e.g., axially extending channels extending through wickers 12, 18 to prevent them from sealing) in order to minimize the probability of a hydraulic lock.

In the example embodiment of FIG. 1, seal ring 23 is uni-directional, having an upper section only; however, a seal ring that is bi-directional may optimally be used. The upper section has slot 35 with an upper and lower portion (not shown in FIG. 1). The inner and outer surfaces forming slot 35 comprise generally cylindrical surfaces, that when viewed in an axial cross-section are generally parallel and each follow a straight line. Features of the upper and lower portions of the slot 35 are discussed in more detail in the description of FIGS. 3 and 4.

Still primarily referring to FIG. 1, seal ring 23 includes outer seal leg 31 with extension member portion 46 having an upper end that terminates in a threaded fitting 47 with annular nut 44. Seal ring 23 may be comprised of metal, soft metal, or an elastomeric material. Outer seal leg 31 extends upward along the inner diameter surface of wellhead housing 10. Outer seal leg 31 is a generally annular member having a cross-sectional thickness less than the thickness of seal pocket 17. Extension member portion 46 can comprise resilient load-bearing material, examples of which include steel, metal alloys, and composites.

Seal ring 23 further includes inner seal leg 27 shown spaced laterally from outer seal leg 31 above lower extension 100. Outer seal leg 31 and inner seal leg 27 are substantially perpendicular to the axis of the wellhead assembly. The casing hanger 15 has conical portion 42 that is engaged by a lower portion of inner seal leg 27.

Annular energizing ring 41 engages slot 35 on the upper side. As shown, energizing ring 41 has an axis $A_R$ that is substantially parallel with an axis (not shown) of the wellhead assembly. Energizing ring 41 is forced downward into slot 35 by a running tool (not shown) connected to grooves 43 on the inner diameter of upper energizing ring 41 during setting. Alternatively, seal assembly 21 and energizing ring 41 may be part of a string that is lowered into bore 11, the weight of which forces energizing ring 41 into slot 35. If retrieval is required, the grooves 43 can be engaged by a retrieving tool (not shown) to pull energizing ring 41 from set position. Energizing ring 41 can be formed of metal, such as steel.

Figure 2:
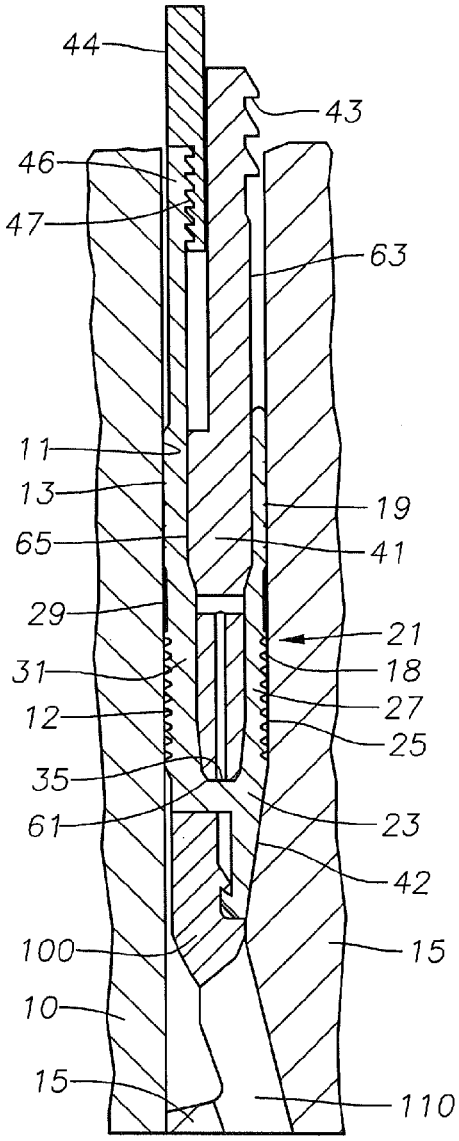
FIG. 2 is a sectional view of the seal assembly of FIG. 1 landed between outer and inner wellhead members in a set position, in accordance with an embodiment of the invention.

Referring now to FIG. 2, energizing ring 41 is put in a set position by downwardly pushing energizing ring 41 into slot 35 of seal ring 23. Energizing ring 41 has nose 61 or engaging portion that engages slot 35. Specifically, energizing ring 41 has inner surface 63 and outer surface 65 for engaging the opposite inner sidewalls of slot 35 in seal ring 23 as shown in FIG. 2. Inner and outer surfaces 63, 65 may be straight surfaces as shown or optimally curved surfaces. Features of inner and outer surfaces 63, 65 of energizing ring 41 are discussed in more detail in the description of FIGS. 3 and 4.

In the example embodiment of FIG. 1, lower extension 100 is engaged and ratcheted to a bottom portion of seal ring 23. Lower extension 100 extends down and rests on a shoulder of the casing hangar 15. The casing hanger 15 has a set of flowby holes 110 positioned at regular intervals along the perimeter of the shoulder of casing hanger 15, where the flowby holes 110 permit flowby during running and cementing operations after the casing hanger 15 has been landed.

Figure 4:
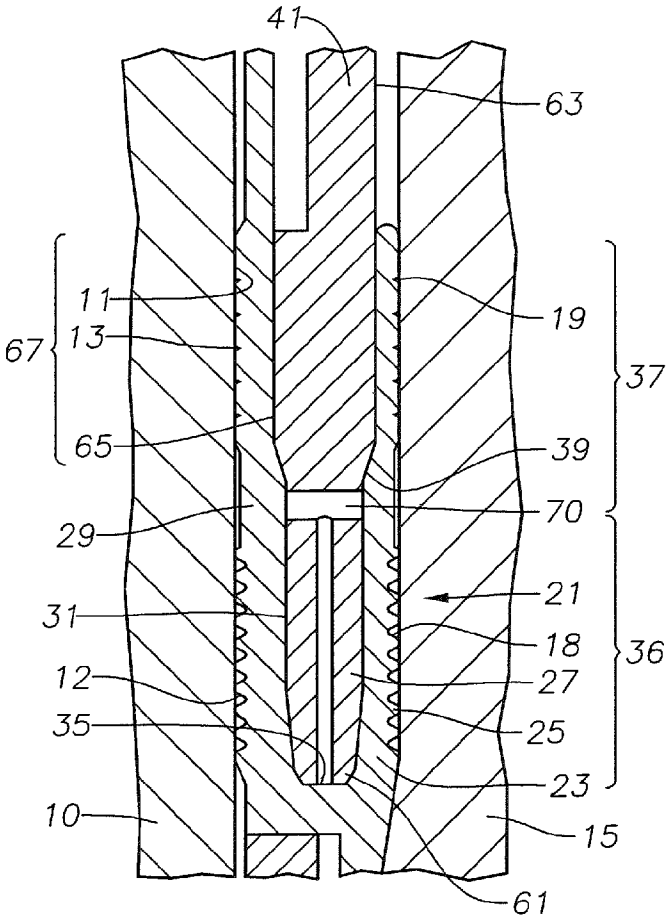
FIG. 4 is a sectional view of the nose of an energizing ring after entering a slot of a seal ring and deforming walls of the seal ring, in accordance with an embodiment of the invention.
Figure 3:
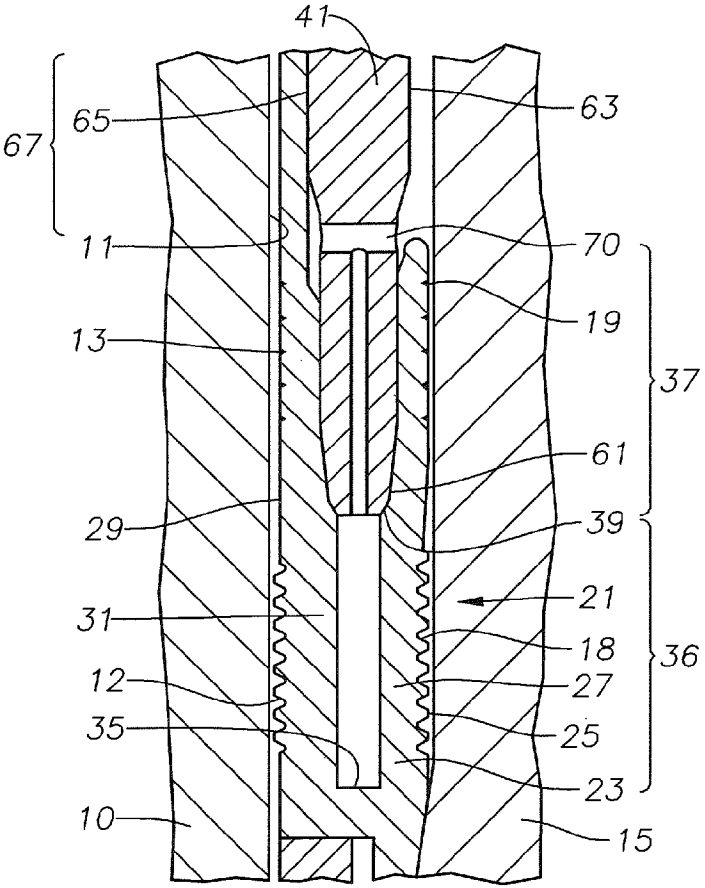
FIG. 3 is a sectional view of the nose of an energizing ring before entering the slot of a seal ring, in accordance with an embodiment of the invention.

Referring to FIGS. 3 and 4, an enlarged sectional view of the nose 61 of the energizing ring 41 is shown in the unset and set positions, respectively. The nose 61 may have a vent 70 to prevent hydraulic locking and may have a tapered surface. In this example, the inner and outer legs 27, 31 of the seal ring 23 have tapered, upward facing shoulders at their upper ends and proximate the opening of the slot 35. The shoulders form a corresponding surface on which the tapered surface of the nose 61 rests when in the unset position.

Slot 35 of seal ring 23 has lower portion 36 and upper portion 37, where lower portion 36 has a radial width that is less than the radial width of upper portion 37 of slot 35. Seal ring 23 may have conical transition 39 between its upper portion 37 and lower portion 36. Similar to seal ring 23, energizing ring 41 has nose 61 and upper end portion 67, where nose 61 has a cross-sectional thickness that is less than the cross-sectional thickness of upper end portion 67. Said another way, inner surface 63 at upper end portion 67 has an inner diameter that is less than the inner diameter of inner surface 63 at nose 61, and outer surface 65 at upper end portion 67 has an outer diameter that is greater than the outer diameter of outer surface 63 at nose 61.

Lower portion 36 of slot 35 may have a relative radial width that is about half the radial width of upper portion 37 of slot 35. Further, upper portion 37 of slot 35 may have a relative axial length that is about 80% of the axial length of lower portion 36 of slot 35. In other embodiments, upper portion 37 of slot 35 may have a relative axial length that is in a range of 60%-100% of the axial length of lower portion 36 of slot 35. The differences between the inner diameters of the inner wall and outer diameters of the outer wall in upper section 67 and nose 61 of energizing ring 41 may be proportional to the difference between the radial widths of the upper and lower portions 37, 36 of the slot 35. Those skilled in the art will appreciate that slot 35 and energizing ring 41 may have various relative widths, lengths, and thicknesses in other embodiments.

As force is applied to energizing ring 41, nose 61 enters slot 35 and thereby deforms the legs 27, 31 of seal ring 23 against walls of housing 10 and casing hanger 15. Specifically, as nose 61 engages lower portion 36 of slot 35, upper end portion 67 of energizing ring 41 engages upper portion 37 of slot 35. In some embodiments, nose 61 and upper end portion 67 of energizing ring 41 can initially engage the portions 36, 37 of slot 35 at substantially the same time as force is applied to energizing ring 41. Alternatively, the engagement of nose 61 and upper end portion 67 of energizing ring 41 with the portions 36, 37 of slot 35 can be staggered (e.g., nose 61 of energizing ring 41 may initially engage lower portion 36 of slot 35 prior to the engagement of upper end portion 67 of energizing ring 41 with upper portion 37 of slot 35).

In an example operation of the embodiment shown in FIGS. 1-4, a running tool or string (not shown) is attached to seal assembly 21 (FIG. 1) and lowered into the seal pocket 17. Seal assembly 21 may be pre-assembled with energizing ring 41, retainer ring 44, seal ring 23, and lower extension 100, all connected as shown in FIG. 1. The running tool or string (not shown) can be attached to grooves 43 on energizing ring 41. In this example, outer wall 29 of outer seal leg 31 and inner wall 25 of inner seal leg 27 have wickers 12, 18, respectively, adjacent to lower portion 36 of slot 35 and interruptions 13, 19 (e.g., indentations, O-ring slots, curved grooves, etc.), respectively, adjacent to upper portion 37 of slot 35. The interruptions 13, 19 can provide a disruption in contact pressure to thereby concentrate the pressure over a smaller band to form a more robust seal. The energizing ring 41 is pushed downward (such as by the running tool) with sufficient force such that nose 61 transmits force to lower portion 36 of slot 35 and upper end portion 67 transmits force to upper portion 37 of slot 35. Insertion of energizing ring 41 causes the seal legs 27, 29 to bulge outwards and sealingly engage the walls of housing 10 and casing hanger 15.

As nose 61 of energizing ring 41 engages lower portion 36 of slot 35, wickers 18 on inner wall 25 of inner seal leg 27 embed into the outer wall of casing hanger 15, and wickers 12 on outer wall 29 of outer seal leg 31 embed into the inner wall of wellhead housing 10. In other embodiment, only one of outer wall 29 of outer seal leg 31 and inner wall 25 of inner seal leg 27 may have wickers, adjacent to lower portion 36 of slot 35. Once embedded, wickers 12, 18 lock seal ring 23 into place thereby minimizing axial movement of seal ring 23. Those skilled in the art will appreciate that various configurations (e.g., different quantities of wickers, various metal compositions, etc.) of wickers 12, 18 can be used to modify the characteristics of their locking feature. Further, as upper end portion 67 of energizing ring 41 engages upper portion 37 of slot 35, inner wall 25 of inner seal leg 27 adjacent to upper portion 37 engages the outer wall of the casing hanger 15, and outer wall 29 of outer seal leg 31 adjacent to upper portion 37 engage the inner wall of wellhead housing 10. The inner and outer walls 25, 29 form a seal in the annular space between the casing hanger 15 and the wellhead housing 10. In some embodiments, the inner and outer walls 25, 29 adjacent to the upper portion 37 can include interruptions (e.g., indentations, O-ring slots, etc.) to alter the characteristics of the seal formed in the annular space. In this case, the interruptions can provide a disruption in contact pressure to thereby concentrate the pressure over a smaller band to form a more robust seal.

Because the locking feature (i.e., wickers 12, 18 adjacent to lower portion 36) and sealing feature (i.e., inner and outer walls 25, 29 adjacent to the upper portion 37) of seal ring 23 are segregated, the features can be independently configured in order to tune their performance. Further, the non-uniform thickness of upper end portion 67 and nose 61 of energizing ring 41 allows an optimal radial engagement to be independently configured for the locking feature and the sealing feature. In the example shown in FIGS. 1-4, the sealing feature of seal ring 23 is positioned above the locking feature; however, the position of the features can be modified in other embodiments. For example, the locking feature (e.g., wickers) can be positioned above the sealing feature in an alternative embodiment.

Subsequently, during production, hot well fluids may cause the casing to grow axially due to thermal growth. If so, casing hanger 15 may move upward relative to wellhead housing 10. Inner seal leg 27 will move upward with casing hanger 15 and relative to outer seal leg 31. Wickers 12, 18 will maintain locking engagement with inner wall 25 of inner seal leg 27 and outer wall 29 of outer seal leg 31.

In the event that seal assembly 21 is to be removed from bore 11, a running tool is connected to threads 43 on upper energizing ring 41. An upward axial force is applied to upper energizing ring 41, causing it to withdraw from slot 35. In this case, once annular nut 44 is engaged by the energizing ring 41, the upward axial force withdraws seal assembly 21 from bore 11.

In an additional embodiment (not shown), wellhead housing 10 could be a tubing spool or a Christmas tree. Furthermore, casing hanger 15 could instead be a lockdown hanger, tubing hanger, plug, safety valve or other device.

While the invention has been shown in only one of its forms, it should be apparent to those skilled in the art that it is not so limited but is susceptible to various changes without departing from the scope of the invention. For example, while the embodiments above are described with respect to a housing and casing hanger, the seal may be configured to be used in various annular spaces (e.g., between nested casing hangers) of a wellhead assembly. In another example, wickers may be located on the surfaces of the casing hanger and wellhead housing rather than on the seal ring.

What is claimed is:

1. A wellhead assembly comprising:

an outer wellhead member having a bore axially extending therein;

an inner wellhead member positioned in the bore of the outer wellhead member;

an annular space positioned between outer wall portions of the inner wellhead member and inner wall portions of the outer wellhead members;

a seal member having inner and outer walls defining a slot therebetween and positioned in the annular space, the slot having an upper portion and a lower portion, the upper portion of the slot having a greater radial width than the lower portion; and an energizing ring having a cylindrical upper end portion with an axial length the same as an axial length of the upper portion of the slot, and a cylindrical nose with an axial length the same as an axial length of the lower portion of the slot, the cylindrical upper end portion including:

an inner wall having a lesser inner diameter than an inner diameter of the cylindrical nose, and an outer wall having a greater outer diameter than an outer diameter of the cylindrical nose.

2. The wellhead assembly as claimed in claim 1, further comprising a set of wickers formed in at least one of the outer and inner walls of the seal member, the set of wickers being positioned to be adjacent to the lower portion of the slot.

3. The wellhead assembly as claimed in claim 2, further comprising a sealing surface defined on at least one of the outer and inner walls of the seal member, the sealing surface including a set of annular grooves for concentrating contact pressure of the sealing surface.

4. The wellhead assembly as claimed in claim 3, wherein the sealing surface is positioned to be adjacent to the upper portion of the slot and forms a seal against the outer wall portions of the inner wellhead member when the upper end of the energizing ring engages the upper portion of the slot.

5. The wellhead assembly as claimed in claim 4, wherein the inner and outer wall portions engaging the set of wickers are fabricated from a metal that is softer than the set of wickers.

6. The wellhead assembly as claimed in claim 2, wherein the set of wickers comprises a plurality of concentric grooves, each of the concentric grooves being triangular in configuration.

7. The wellhead assembly as claimed in claim 1, wherein the upper portion of the slot has a relative axial length in a range of about 60-100% of an axial length of the lower portion of the slot.

8. A wellhead assembly comprising:

an outer wellhead member having a bore axially extending therein;

an inner wellhead member positioned in the bore of the outer wellhead member;

an annular space positioned between outer wall portions of the inner wellhead member and inner wall portions of the outer wellhead members;

a seal member having inner and outer walls defining a slot therebetween and positioned in the annular space, the slot having an upper portion and a lower portion, the upper portion of the slot having a greater radial width than the lower portion; and an energizing ring having a cylindrical upper end portion with an axial length the same as an axial length of the upper portion of the slot, and a cylindrical nose with an axial length the same as an axial length of the lower portion of the slot, the cylindrical upper end portion including:

an inner wall having a lesser inner diameter than an inner diameter of the cylindrical nose, and an outer wall having a greater outer diameter than an outer diameter of the cylindrical nose;

the seal member further having:

a sealing surface positioned to be adjacent to the upper portion of the slot, the sealing surface forming a seal against the outer wall portions of the inner wellhead member and the inner wall portions of the outer wellhead member when the upper end of the energizing ring engages the upper portion of the slot, and a set of wickers on the seal member and adjacent to the lower portion of the slot.

9. The wellhead assembly as claimed in claim 8, wherein the set of wickers are on only one of an inner wall surface and an outer wall surface of the seal member.

10. The wellhead assembly as claimed in claim 8, wherein the set of wickers are on an inner wall surface and an outer wall surface of the seal member.

11. The wellhead assembly as claimed in claim 8, further comprising a set of curved grooves on the sealing surface for concentrating contact pressure of the sealing surface.

12. The wellhead assembly as claimed in claim 8, wherein the inner and outer wall portions engaging the set of wickers are fabricated from a metal that is softer than the set of wickers.

13. The wellhead assembly as claimed in claim 8, wherein the set of wickers comprises a plurality of concentric grooves, each of the concentric grooves being triangular in configuration.

14. The wellhead assembly as claimed in claim 8, wherein the upper portion of the slot has a relative axial length in a range of about 60-100% of an axial length of the lower portion of the slot.

15. A method of installing a wellhead assembly, comprising:

installing an outer wellhead member having a bore axially extending therein;

installing an inner wellhead member positioned in the bore of the outer wellhead member and located relative to the outer wellhead member such that outer wall portions of the inner wellhead member and inner wall portions of the outer wellhead members define an annular space;

installing a seal member having inner and outer walls defining a slot therebetween and positioned in the annular space, the slot having an upper portion and a lower portion, the upper portion of the slot having a greater radial width than the lower portion;

providing an annular energizing ring having a sidewall with a thickness that changes at a transition to define, a nose portion below the transition that is tuned to be inserted into the lower portion of the slot and to urge the outer walls adjacent the lower portion radially outward and into engagement with the wall portions of the inner and outer wellhead portions, and an upper portion above the transition that is tuned to be inserted into the upper portion of the slot and urge the outer walls adjacent the upper portion radially outward into engagement with the wall portions of the inner and outer wellhead portions;

installing an annular energizing ring into the slot formed by the inner and outer seal legs, the annular energizing ring comprising:

an inner wall having a lesser inner diameter than an inner diameter of the cylindrical nose, and an outer wall having a greater outer diameter than an outer diameter the cylindrical nose; and applying downward axial force to push the annular energizing ring further into the slot to thereby exert increased radial force through the upper portion and the lower portion of the slot.

16. The method as claimed in claim 15, wherein the seal member comprises a set of wickers formed in at least one of the outer and inner walls of the seal member, the set of wickers being positioned to be adjacent to the lower portion of the slot.

17. The method as claimed in claim 16, wherein the seal member further comprises a sealing surface defined on at least one of the outer and inner walls of the seal member, the sealing surface including a set of annular grooves for concentrating contact pressure of the sealing surface.

18. The method as claimed in claim 17, wherein the sealing surface is positioned to be adjacent to the upper portion of the slot and forms a seal against the outer wall portions of the inner wellhead member when the upper end of the energizing ring engages the upper portion of the slot.

* * * * *